US006550767B2

(12) United States Patent
Pittman

(10) Patent No.: US 6,550,767 B2
(45) Date of Patent: Apr. 22, 2003

(54) CHILDREN'S TOY

(76) Inventor: Chester L. Pittman, 2225 Adams St. NE., Palm Bay, FL (US) 32905

( * ) Notice: Subject to any disclaimer, the term of this patent is extended or adjusted under 35 U.S.C. 154(b) by 0 days.

(21) Appl. No.: 09/827,458

(22) Filed: Apr. 6, 2001

(65) Prior Publication Data

US 2002/0145251 A1 Oct. 10, 2002

(51) Int. Cl.[7] ..... A63B 71/00
(52) U.S. Cl. ..... 273/138.1; 273/142 R
(58) Field of Search ..... 273/138, 147, 273/142 R, 440, 142 J, 142 JA, 142 JB, 142 JC, 142 JD; 446/236, 487

(56) References Cited

U.S. PATENT DOCUMENTS

| | | | | | |
|---|---|---|---|---|---|
| 222,710 | A | * | 12/1879 | Kightlinger | 273/142 JA |
| 329,372 | A | * | 10/1885 | Dennings | 273/142 R |
| 497,906 | A | * | 5/1893 | Bettini | 194/294 |
| 518,726 | A | * | 4/1894 | Roever | |
| 818,153 | A | * | 4/1906 | Ehebald | 273/142 J |
| 1,167,077 | A | * | 1/1916 | Jessen | 273/142 R |
| 1,458,468 | A | * | 6/1923 | Doner | 273/141 R |
| 1,570,846 | A | * | 1/1926 | Kussner | 273/138.1 |
| 1,988,362 | A | * | 1/1935 | Quackenbush | 131/242.6 |
| 2,001,330 | A | * | 5/1935 | McKeever | 273/142 J |
| 2,043,047 | A | * | 6/1936 | Lairet | 273/142 JC |
| 2,245,844 | A | * | 6/1941 | Willig | 273/138.1 |
| 2,280,623 | A | * | 4/1942 | Broomfield | 273/138.1 |
| D163,281 | S | * | 5/1951 | Haupenthal | D34/5 |
| D164,605 | S | * | 9/1951 | Romanchek | D34/13 |
| 2,635,384 | A | * | 4/1953 | Rosenthal | 273/142 R |
| 2,687,890 | A | * | 8/1954 | Hedin | 273/142 R |
| 2,736,557 | A | * | 2/1956 | Androsiglio | 273/142 R |
| 2,794,643 | A | * | 6/1957 | LaFleur | 273/138.1 |
| 2,825,566 | A | * | 3/1958 | Stutzner | 273/138.1 |
| 3,166,323 | A | * | 1/1965 | Anderson | 273/119 R |
| 3,232,622 | A | * | 2/1966 | Lambert | 273/141 A |
| 3,464,698 | A | * | 9/1969 | Bosco | 116/222 |
| 3,572,719 | A | * | 3/1971 | Span et al. | 273/139 |
| 3,709,500 | A | * | 1/1973 | Coby | 124/33 |
| 3,759,524 | A | * | 9/1973 | McNaney | 273/142 A |
| 3,787,050 | A | * | 1/1974 | Goldfarb | 273/120 R |
| 3,803,735 | A | * | 4/1974 | Stubbmann | 40/414 |
| 3,810,628 | A | * | 5/1974 | Vigan | 273/142 HA |
| 3,817,532 | A | * | 6/1974 | Lee | 273/142 HA |

(List continued on next page.)

*Primary Examiner*—Benjamin H. Layno
*Assistant Examiner*—Dolores Collins
(74) *Attorney, Agent, or Firm*—John L. DeAngelis, Jr.; Buesse Brownlee Bowdoin & Wolter, P.A.

(57) ABSTRACT

A game or toy device into which the player enters a random number is disclosed. The random number is entered by rotating a handle after which a plunger is depressed. Entry of the random number may permit free depression of the plunger and thereby allow the plunger to activate a pitching mechanism for ejecting a substance (such as water or paper confetti) in the direction of the game player.

1 Claim, 2 Drawing Sheets

U.S. PATENT DOCUMENTS 3,841,629 A * 10/1974 Barlow ..... 273/440
3,861,686 A * 1/1975 Breslow et al. ..... 273/138.1
3,949,990 A * 4/1976 Polonyi ..... 273/118 A
4,036,502 A * 7/1977 Levy ..... 116/223
4,043,406 A * 8/1977 Wolf ..... 273/138.1
4,162,069 A * 7/1979 Goldfarb et al. ..... 273/440
4,196,365 A * 4/1980 Presley ..... 310/103
4,236,344 A * 12/1980 Kelly ..... 414/719
4,356,657 A * 11/1982 Goldfarb et al. ..... 446/236
4,455,783 A * 6/1984 Nagano ..... 446/446
4,509,754 A * 4/1985 Remmler et al. ..... 273/142 J
4,524,967 A * 6/1985 Hanson et al. ..... 273/273
4,618,330 A * 10/1986 Abe ..... 446/236
4,643,692 A * 2/1987 Magers ..... 446/236
4,661,080 A * 4/1987 Goldstein et al. ..... 273/440
4,828,258 A * 5/1989 Gebert ..... 273/108
5,238,440 A * 8/1993 Morin ..... 273/142 E
5,275,402 A * 1/1994 Malavazos et al. ..... 273/138.2
5,313,727 A * 5/1994 Murray, Jr. ..... 40/410
5,316,309 A * 5/1994 Takeshi ..... 273/138.1
5,339,923 A * 8/1994 Chen ..... 185/39
5,370,393 A * 12/1994 Taylor et al. ..... 273/142 HA
5,980,357 A * 11/1999 Newby ..... 446/359
6,039,626 A * 3/2000 Gerold et al. ..... 446/175
6,149,490 A * 11/2000 Hampton et al. ..... 446/298
6,254,479 B1 * 7/2001 Okitani et al. ..... 273/138.2
6,270,080 B1 * 8/2001 Chang ..... 273/138.3

* cited by examiner

CHILDREN'S TOY

BACKGROUND OF THE INVENTION

This invention relates generally to a children's game or toy, and more specifically to a children's game or toy wherein the selection of a random number and the application of that number to the game mechanism may cause the release of a pitching mechanism containing water or other material directed toward the game player.

There are countless children's games and toys designed to amuse and occupy children (and in some cases adults also). In one class of such games, a random number or letter is selected by the player followed by the manipulation of an article or device that provides a number or letter as an output value. If the output value matches the selected random number, the player is declared a winner. Probably the simplest example of such a game is the use of cubicle die wherein each cube face depicts a number from one to six. Typically, the cube faces are marked with dots to represent the number. The game player selects a number from one to six (or higher numbers if more than one die is used) and the die is rolled along a horizontal surface until it comes to a stop with one cube face up. If the number depicted by the exposed cube face is the same as the number selected by the player, then the player is declared a winner of the game.

BRIEF DESCRIPTION OF THE DRAWINGS

The present invention may be better understood and the further uses and advantages thereof more readily apparent when considered in conjunction with the following figures in which.

DETAILED DESCRIPTION OF THE PREFERRED EMBODIMENTS

Before describing in detail the particular game or toy in accordance with the present invention, it should be observed that the present invention resides primarily in a novel and non-obvious combination of hardware components. Accordingly, the hardware components have been represented by conventional elements in the figures, showing only those specific details that are pertinent to the present invention so as not to obscure the disclosure with structural details that would be readily apparent to those skilled in the art having the benefit of the description herein.

Figure 1:
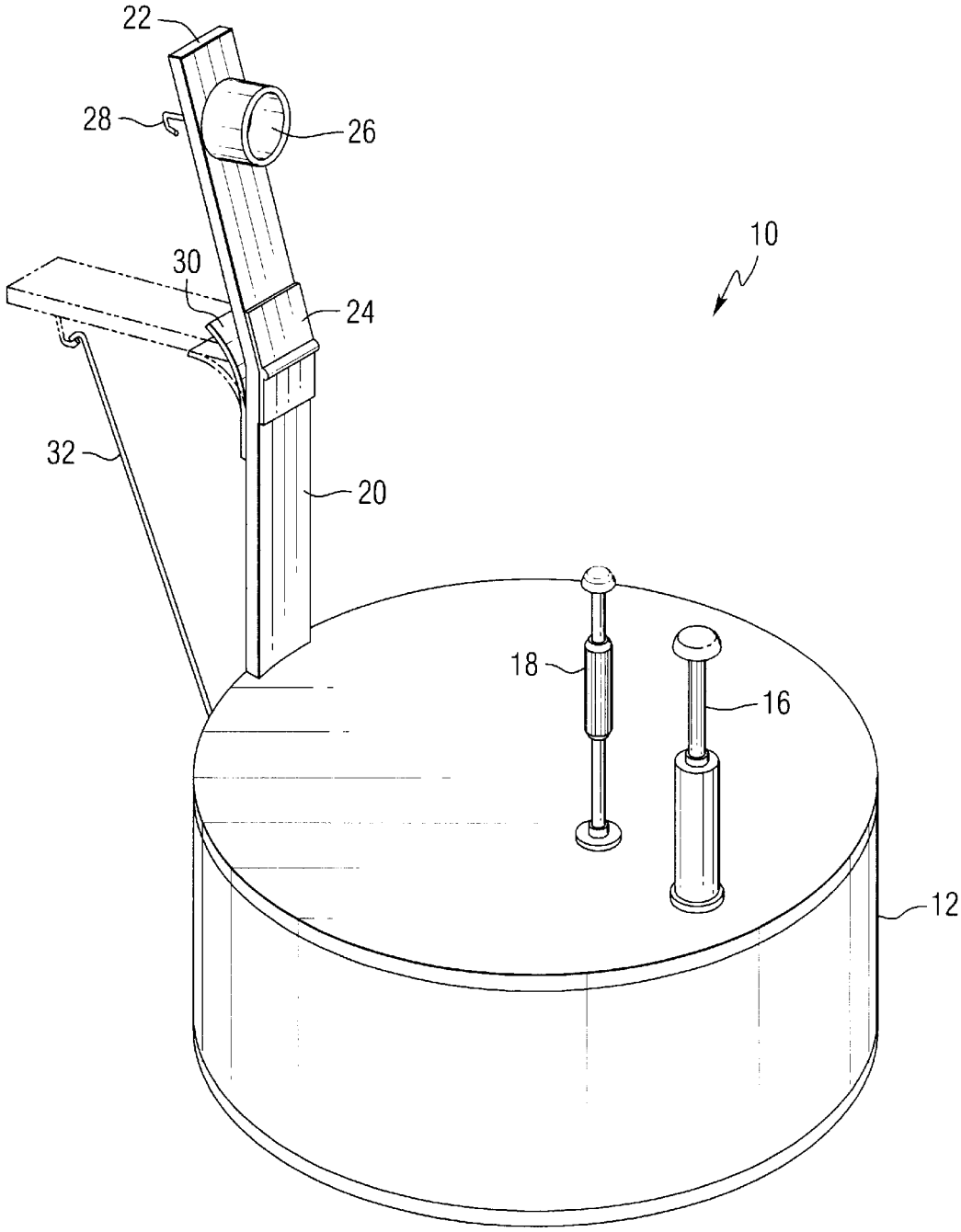
FIG. 1 is a prospective view of the game device of the present invention.

FIG. 1 illustrates a game 10 including a base 12. A plunger 16 and a rotatable handle 18 extend above the base 12 for manipulation by the player. Also affixed to the base 12 is a support member 20 for supporting a pitching mechanism 22. The support member 20 and the pitching mechanism 22 are joined by a hinge 24 that allows the pitching mechanism 22 to be rotated relative to the support member 20. Affixed to the pitching mechanism 22 is a hollow cup or container 26. Further affixed to the pitching mechanism 22 is a hook 28. A spring member 30 is affixed near the top edge of the support member 20 as shown. Further affixed to the base is a hook 32.

As a first step in operating the game, the pitching mechanism 22 is rotated away from the base 12 as shown by the phantom representation in FIG. 1. This movement causes flexing of the spring member 30 as also shown by the phantom representation in FIG. 1. After the pitching mechanism 22 is rotated into this position, the hook 28 is engaged to the hook 32 so as to hold the pitching mechanism biased against the spring member 30.

Figure 2:
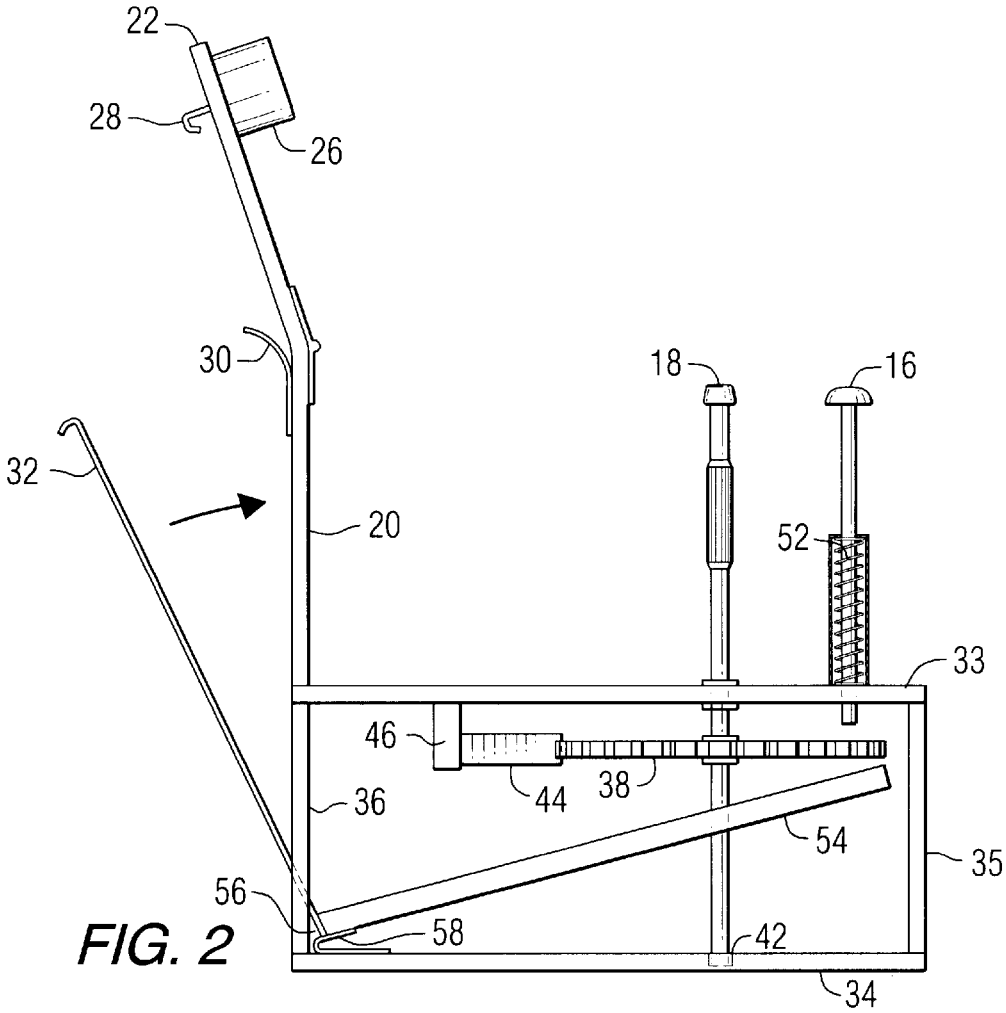
FIG. 2 illustrates the internal components of the game base illustrated in FIG. 1.

In a second step of the game, the player chooses a random number that can range from one to about 20 or 30. In fact, any number can be chosen, but to make the game manageable the maximum chosen number should be in the range of 20 to 30. The player then rotates the rotatable handle 18 through a number of turns equal to the chosen random number. Turning to FIG. 2, it is seen that the rotatable handle 18 is affixed to a disk 38, and rotates within a well 42 of a bottom frame member 34. A top frame member 33 and a bottom frame member 34 of the base 12 are connected at the ends thereof by vertical members 35 and 36. Rotation of the rotatable handle 18 turns the disk 38.

The disk 38 includes a plurality of notches 43 located around the circumference thereof. See FIG. 3. Returning to FIG. 2, there is shown an arm 44 extending from a support member 46, which is attached to the top frame member 33. The arm 44, which in one embodiment is a relatively thin metallic piece, sequentially engages the notches 43 as the disk 38 is rotated by the rotatable handle 18, which creates a detent mechanism. As the player rotates the rotatable handle 18, each notch is in turn engaged by the arm 44, so that the game player simply counts the number of detent actions until the chosen random number is reached.

Figure 3:
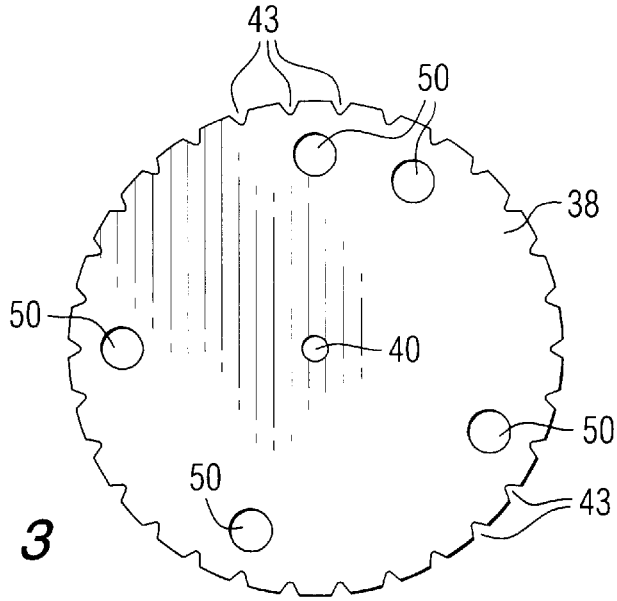
FIG. 3 illustrates the disk illustrated in FIG. 2.

Note further from FIG. 3 that the disk 38 includes a plurality of randomly spaced holes 50. As the disk 38 is rotated, one of these holes may be rotated into position beneath the plunger 16. The plunger 16 is biased upwardly by a helical spring 52, but can be pushed downwardly by the player. After the random number is entered by rotating the rotatable handle 18, the player pushes downward on the plunger 16. If none of the holes 50 is aligned with the plunger 16, the plunger will simply strike the top surface of the disk 38 and return to its upward position through operation of the helical spring 52.

Alternatively, if one of the holes 50 has been rotated into position below the plunger 16, the downward force on the plunger 16, extends the plunger through the hole 50, where it contacts a lever member 54. See FIG. 2. As shown, the lever member 54 is attached at the fulcrum end to a U-shaped spring steel member 58, which biases the lever member 54 into the position shown. In one embodiment, the rotatable handle 18 passes through the lever member 54. In another embodiment a groove or notch can be cut into the lever member 54, allowing sufficient clearance for the rotatable handle 18. When the plunger 16 is depressed through a hole 50 into contact the lever member 54, the lever member 54 rotates against the bias provided by the spring steel member 58. This movement of the lever member 54 causes movement of the hook 32 as shown by the arrow in FIG. 2. As the hook 32 rotates about its attachment point with the support member 20, it disengages from the hook 28 attached to the pitching mechanism 22. At this point, the bias provided by the spring member 30 drives the pitching mechanism 22 into its equilibrium position, at which point water or another substance located within the cup or container 26 is accelerated out of the cup. Typically, during the operation of rotating the rotatable handle 18 and depressing the plunger 16, the player will be situated in front of the game 10 and therefore, in line with the material accelerated out from the cup or container 26. Thus the selection of the right random number may result in the player getting wet and thereby being declared a loser.

As can be appreciate by those skilled in the art, several different embodiments are possible for the present invention. For instance, the spring member 30 and the spring steel member 58 can be replaced by hinge and spring mechanisms to provide an equilibrium position for the associated members while also serving to apply forces to move the associated members as required.

While the invention has been described with reference to a preferred embodiment, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A game device wherein a player chooses a random number that determines whether an element of said game is activated, said game comprising:

a rotatable member, rotated by the player through a number of discrete angular positions equal to the random number;

a plunger, wherein the player attempts to activate the plunger after rotating said rotatable member;

a first member cooperating with said rotatable member, wherein said first member constrains or permits movement of said plunger as determined by the cooperation between said rotatable member and said first member;

wherein when movement of said plunger is allowed by said first member, a second member is activated; and wherein the second member further comprises a container for carrying a substance to be ejected from said container upon activation of the second member.

* * * * *